United States Patent [19]

Sano et al.

[11] Patent Number: 4,976,243

[45] Date of Patent: Dec. 11, 1990

[54] INTERNAL COMBUSTION ENGINE CONTROL SYSTEM

[75] Inventors: Yukinori Sano; Mineo Kashiwaya; Yuuji Ikeda, all of Katsuta, Japan

[73] Assignees: Hitachi, Ltd., Tokyo; Hitachi Automotive Engineering Co., Ltd., Ibaraki, both of Japan

[21] Appl. No.: 418,221

[22] Filed: Oct. 6, 1989

[30] Foreign Application Priority Data

Oct. 14, 1988 [JP] Japan ..... 63-257156

[51] Int. Cl.[5] ..... F02D 41/10; F02D 41/12; F02D 41/18

[52] U.S. Cl. ..... 123/492; 123/493

[58] Field of Search ..... 123/480, 488, 492, 493, 123/494

[56] References Cited

U.S. PATENT DOCUMENTS 4,520,783 6/1985 Matsushita et al. ..... 123/494
4,754,736 7/1988 Yamato et al. ..... 123/492
4,757,793 7/1988 Shimomura et al. ..... 123/488
4,785,785 11/1988 Oba et al. ..... 123/494

FOREIGN PATENT DOCUMENTS 0015740 1/1983 Japan ..... 123/494
5974337 4/1984 Japan .

*Primary Examiner*—Tony M. Argenbright
*Assistant Examiner*—Robert E. Mates
*Attorney, Agent, or Firm*—Antonelli, Terry, Stout & Kraus

[57] ABSTRACT

A fuel supply control system for internal combustion engines with an air flow mounted in a intake manifold, a throttle valve opening sensor and a control unit, in which at quick acceleration the control unit generates a correction air flow quantity signal in accordance with the change of the output of the throttle valve opening sensor and corrects the output signal of the air flow sensor by the correction air flow quantity signal, whereby estimating real air flow quantity sucked into the engine cylinders.

6 Claims, 7 Drawing Sheets

INTERNAL COMBUSTION ENGINE CONTROL SYSTEM

BACKGROUND OF THE INVENTION

1. Field of the Invention

The present invention relates to an internal combustion engine control system suitable for a fuel supply control at a state of quick acceleration or deceleration.

2. Description of the Related Prior Art

As shown in the Japanese laying-open patent publication Sho-59-74337(1984), an ordinary fuel supply system for an internal combustion engine determines the quantity of the fuel supply on the basis of the detected air flow quantity supplied to the engine and compensates the supplied fuel quantity using a compensating coefficient based on detected acceleration and deceleration.

The prior art, however, has given no consideration to the response delay of the air flow sensor at the time of acceleration and deceleration. The quantity of the air supplied to the engine is quickly increased when a throttle valve is opened for the acceleration. However, the output signal of the air flow sensor gradually increases with a time delay and the measured air flow quantity becomes smaller than the air flow quantity actually supplied to the engine. As a result, the control system fails to supply the fuel quantity necessary for complete combustion to the engine.

SUMMARY OF THE INVENTION

It is an object of this invention to provide an improved internal combustion engine control system for estimating the real intake air flow quantity to the engine and supplying the fuel quantity required to burn the fuel completely in the engine cylinders.

The above object is achieved by estimating a real air flow quantity sucked into the engine on the basis of the detected air flow quantity the throttle valve opening and the change of the opening. The fuel quantity to the engine is determined in accordance with the estimated real air flow quantity at the time of quick acceleration or deceleration.

The invention will be better understood and further objects and advantages thereof will become more apparent from the following detailed description of preferred embodiments taken in conjunction with the drawings.

BRIEF DESCRIPTION THE DRAWINGS

DESCRIPTION OF THE PREFERRED EMBODIMENT

Figure 1:
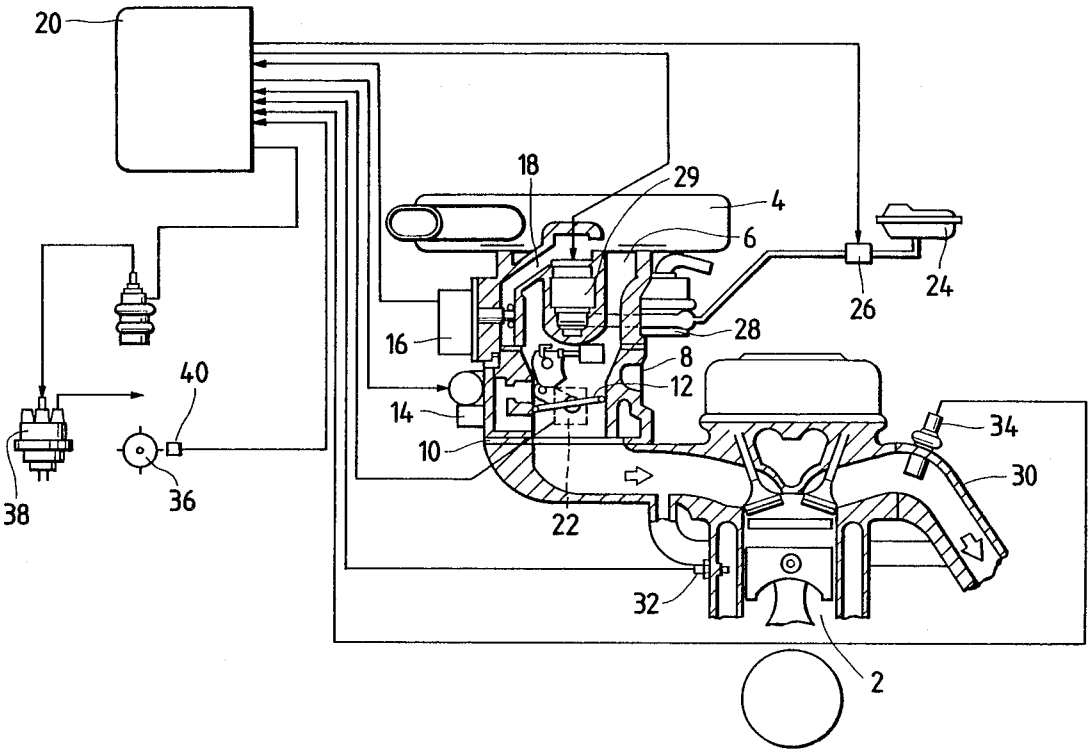
FIG. 1 is a schematic view of an internal combustion engine according to the present invention.

A fuel injection type combustion engine control system using a microcomputer is shown in FIG. 1. In FIG. 1, air is sucked into an engine cylinder 2 through an inlet of an air cleaner 4, a main air passage 6 of a throttle body 8 and sub-air passage 10.

The quantity of air flowing through main air passage 6 is controlled by a throttle valve 12 and the quantity of air flowing through the sub-air passage 10 is controlled by an idle speed control valve 14. The air flow quantity is measured by a hot wire type air flow sensor 16 mounted in a bypass passage 18 and the detected signal is applied to a control unit 20. The throttle valve opening of the throttle valve 12 is detected by a throttle sensor 22 and the signal indicative of the throttle valve opening supplied to the control unit 20.

The fuel supplied from a fuel tank 24 is pressurized by a fuel pump 26 and its pressure is regulated by a pressure regulator 28. The fuel is supplied to the cylinder 2 of the combustion engine through an injector 29 and exhausted from a exhaust manifold 30 after compression and combustion. A water temperature sensor 32 is mounted on the engine and a detection signal is fed to the control unit 20. An air-fuel ratio sensor 34 is provided in the exhaust manifold 30 for measuring oxygen concentration and the detected signal is also supplied to the control unit 20. A rotor 36 rotatably mounted on the distributor 38 generates pulses in synchronism with the revolution of the engine. A crank angle sensor 40 detects the revolution of the distributor 38 as a revolution number of the engine and supplies the output signal to the control unit 20.

Figure 2:
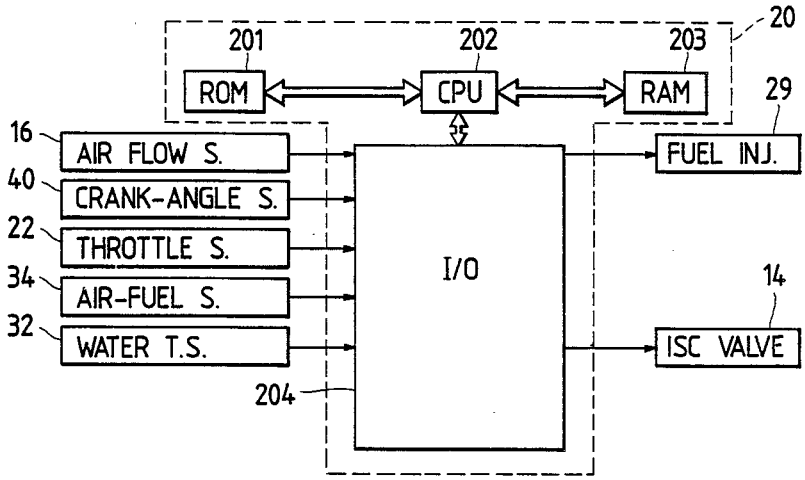
FIG. 2 is a block diagram showing an example of a control unit according to the present invention.

FIG. 2 is a block diagram showing an example of the control unit 20. In FIG. 2, the control unit 20 comprises a read only memory 201, a central processing unit 202, a random access memory 203, and an input/output interface circuit 204. Each output of the sensors is supplied to the central processing unit 202 through the input/output interface circuit 204. The central processing unit 204 performs a calculation in accordance with a program stored in the read only memory 201 and generates a control signal. The control signal is applied to the control system of the engine through the input/output interface circuit 204. The temporary data involved in the calculation is stored in the random access memory 203.

Figure 3:
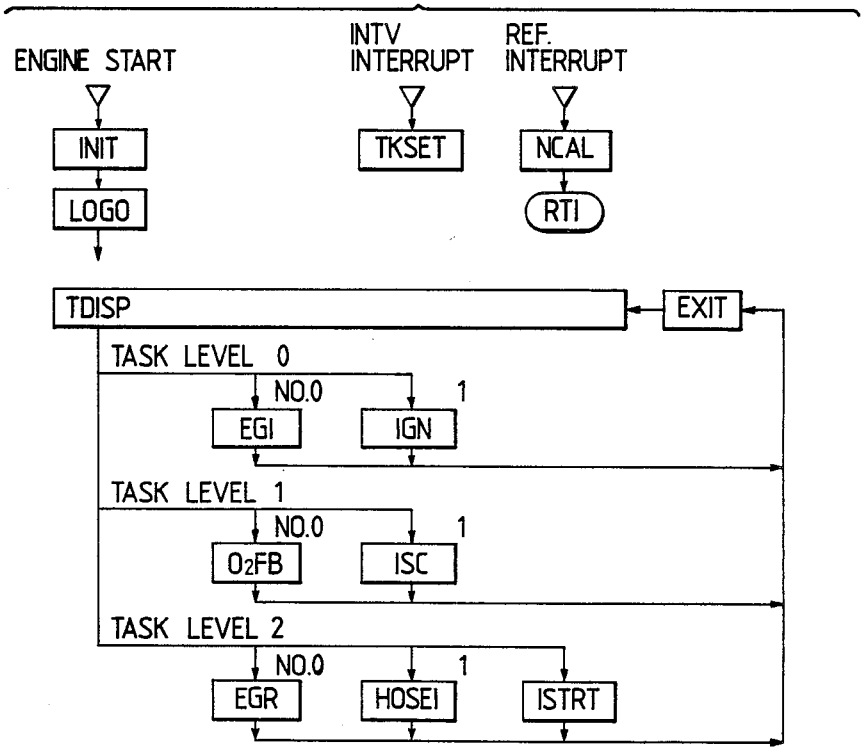
FIG. 3 is a chart showing processing contents of the control unit.

FIG. 3 shows the processing contents of the control unit 20. When a key switch is turned on and the engine is started, a task INIT for starting the central processing unit 202 is executed. Then, the initial processing of the central processing unit 202 and the clearing of random access memory 203 are carried out. Following the above, a task IOGO for starting the input/output interface circuit 204 is carried out and the program performs an initial setting of the input/output and release of the input/output inhibition. After the execution of tasks INIT and IOGO, each task is repeated when the interrupt occurs. Task TKSET is executed by a hard timer at every 5 m sec, and each task marked with a priority level 0, 1, 2 waits for a starting request. Next to the execution of task TKSET, task TDISP is executed and the determination of what task should be executed in the requested tasks is performed in ascending order of the priority level 0, 1, 2. In case a higher priority level task is requested for starting during the starting of a lower priority level task, the processing of the lower priority level task is temporarily stopped. The content of each task is shown in the following table.

TABLE

| | | |
|---|---|---|
| EGI | 10 ms | input processing of $Q_A$<br>calculation processing of $Q_{AT}$<br>output processing of injector |
| IGN | 20 ms | ignition control processing |
| $O_2$FB | 40 ms | $O_2$ feedback processing |
| ISC | 80 ms | idle revolution number control processing |
| EGR | 80 ms | EGR control processing |
| HOSEI | 160 ms | Water temperature correction of each control |
| ISTRT | initial | initial value setting processing<br>input initial processing |

Figure 4:
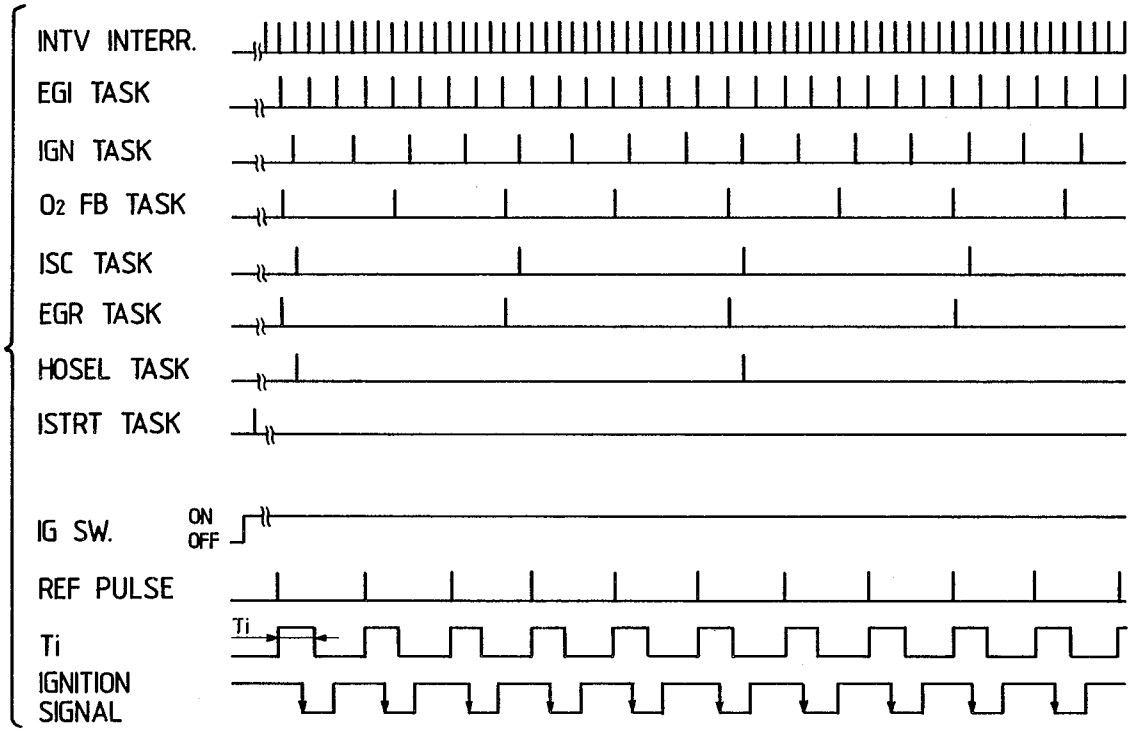
FIG. 4 is a timing chart of the control unit.

At every predetermined revolution number, the interrupt REF occurs to carry out task NCAL. The task performs processing for calculation of the engine revolution number, a starting of the injector 29 and ignition. The timing chart is shown in FIG. 4.

Figure 5:
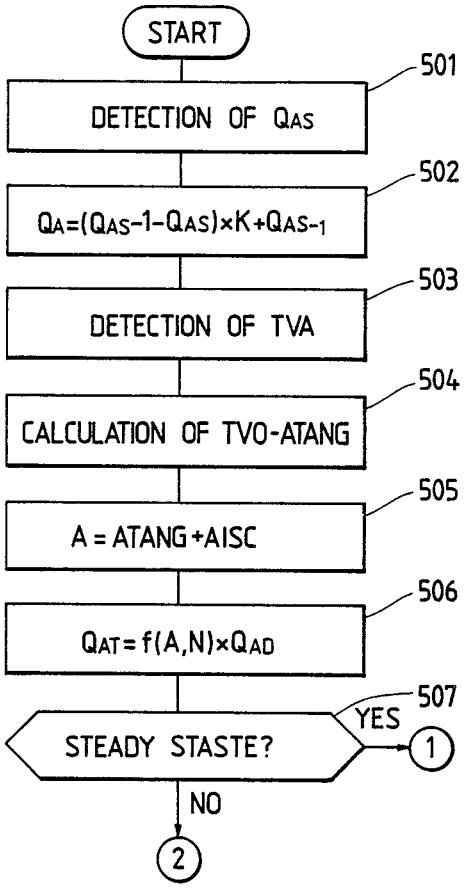
FIGS. 5 to 7 are flowcharts showing detail processing steps carried out by the control unit.
Figure 6:
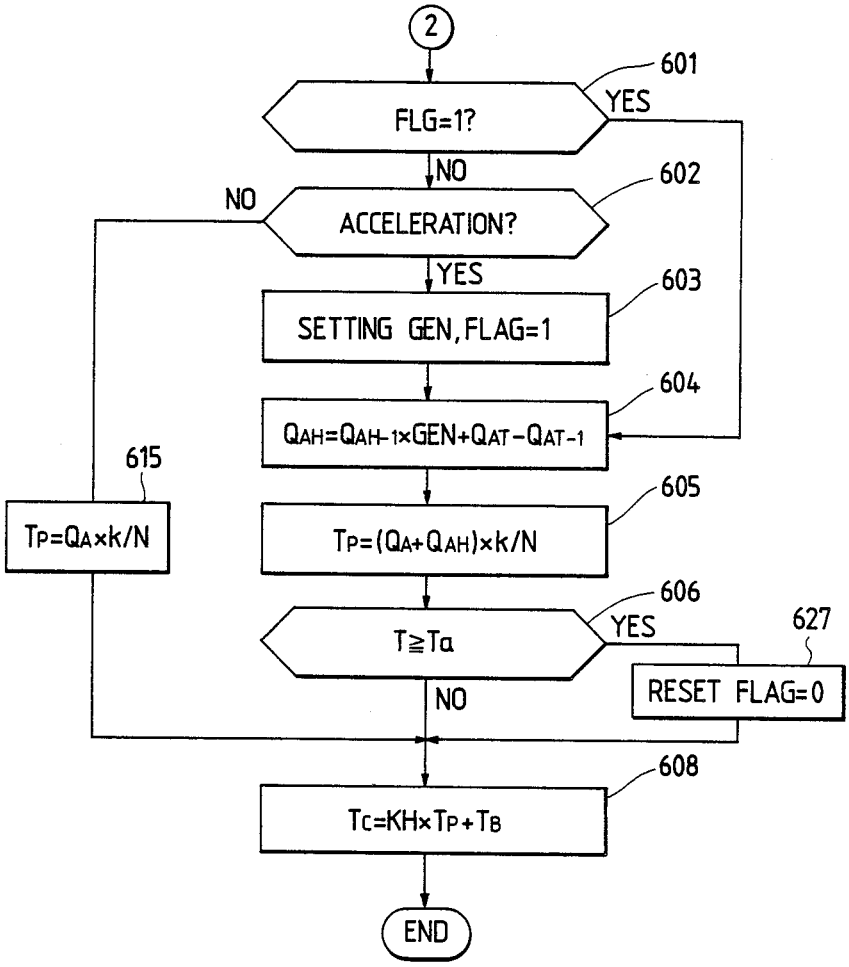
Figure 7:
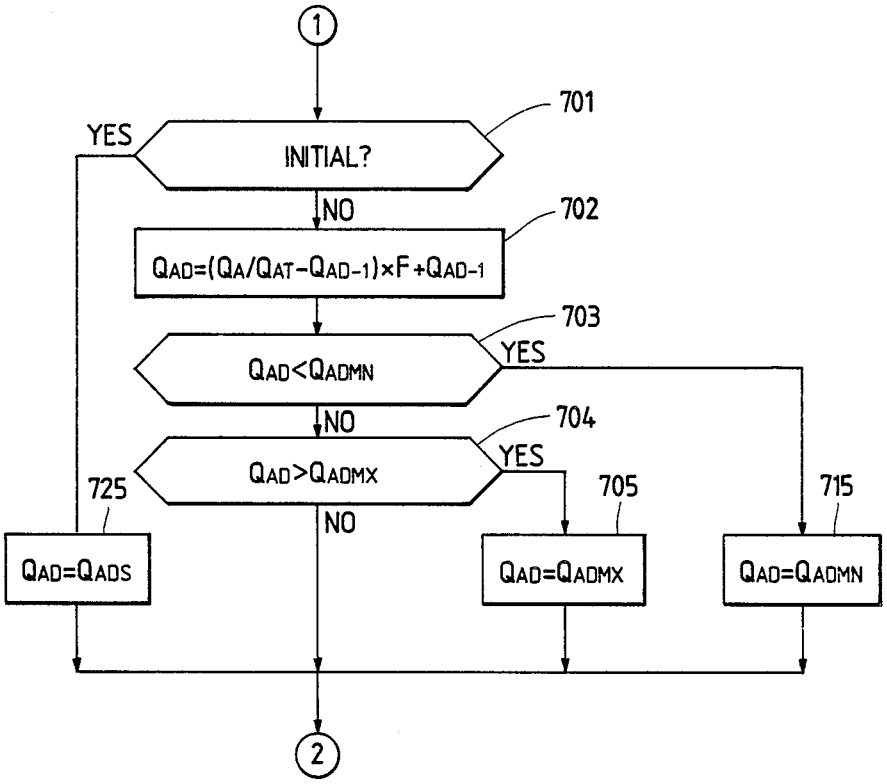

Now, the calculation of the quantity of injected fuel during acceleration is explained by the flow chart of FIGS. 5 to 7. This processing forms a part of task EGI. At step 501, the program calculates the air flow quantity on the basis of the output of a hot wire type air flow sensor 16. At step 502, the air flow quantity $Q_{AS}$ is calculated by filtering the last air flow quantity $Q_{AS\text{-}1}$ and the present air flow quantity QAS. This filtering corrects the pulsation of sucked air and scatter of sucked air quantity between cylinders. At step 503, the output TVO of the throttle sensor 22 is detected and the passage section area ATANG of the throttle valve is calculated from the output TVA of the throttle sensor 22. At step 505, the passage section area AISC of idle speed control valve 10 is calculated from the output signal of the ISC valve 10 and the total passage section area A of the area AISC and ATANG is calculated.

At step 506, estimated air flow quantity is calculated on the basis of the total area A and the engine revolution number, and air flow quantity $Q_{AT}$ is calculated by means of compensation coefficient $Q_{AD}$. The compensation coefficient $Q_{AD}$ is determined by a chart as shown in FIG. 7, and the coefficient compensates for changes of air condition, such as pressure and temperature of the atmosphere. Step 507 judges whether the engine is in a steady state or not.

In determinating the steady state condition, it is judged whether or not changes of engine condition, for example throttle valve opening, engine revolution number, and engine load, stay within a predetermined range during the predetermined period of time.

Figure 10A:
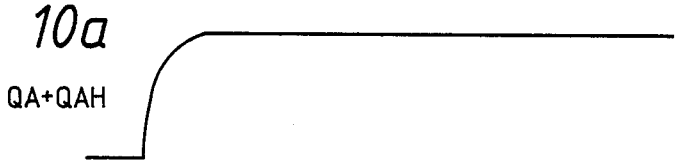
FIG. 10 (*a–c*) is a detection characteristic curve of sucked air quantity.
Figure 10B:
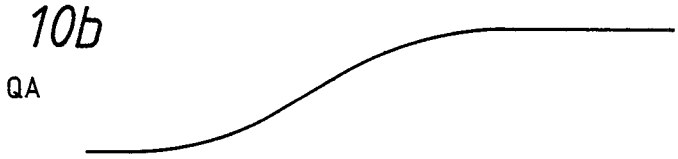

When the throttle valve is opened quickly, the amount of sucked air also increases quickly. In general, the sucked air flow quantity is measured with a hot wire type air flow sensor. However, such air flow sensor has bad-output characteristics for responsiveness as shown in the FIG. 10 output characteristics. It is therefore necessary to regulate the amount of fuel to be supplied to the engine in accordance with the amount of the air sucked into the cylinder so as to equalize the air-fuel ratio of the air fuel mixture to reach a theoretical air-fuel ratio. Accordingly, in case the detected air flow quantity is smaller than the real air flow quantity, the air fuel mixture becomes too lean. As a result, the engine fails to generate a required torque at acceleration and it brings about a misfire owing to a lean air-fuel ratio. To the contrary, when the detected air flow quantity is larger than the real air flow quantity, the air-fuel ratio become too rich and the engine fails to provide complete combustion.

On the other hand, the throttle valve sensor 22 has very high responsiveness to the change of the throttle valve opening. According to the present invention, the air flow quantity detected by the air flow sensor at time of acceleration is corrected on the basis of the output of the throttle sensor 22 shown in FIG. 10*c* and the control unit 20 estimates the real air flow quantity sucked into the cylinder.

Figure 8:
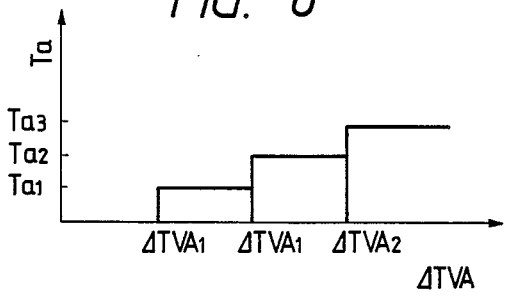
FIG. 8 is a graph showing the relationship between change ΔTVA of the throttle valve opening and time $T_A$.
Figure 9:
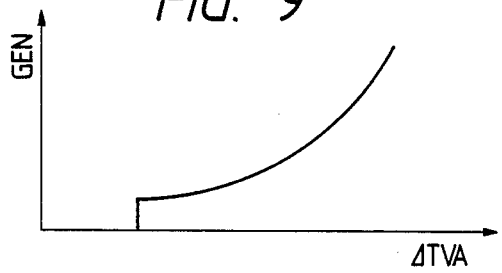
FIG. 9 is a curve showing the relationship between ΔTVA and a coefficient GEN.

In FIG. 6 showing a flowchart, step 601 determines whether flag FLG is equal to 1 or not. This flag FLG is to be turned to "1" at step 603, and this flag means the program is processing for the acceleration. If FLG=1, the program proceeds to step 604 for processing correction of the fuel quantity supplied to the engine. At step 602 the program judges whether the engine is in an acceleration condition or not. For example, the above determination is possible by detecting whether or not the engine condition, such as the throttle valve opening, engine load, and engine revolution number, exceeds the predetermined ranges. At step 603, the program sets time $T_A$ for processing the acceleration and correction coefficient GEN. The setting of $T_A$ and GEN is performed by reading out a predetermined value in accordance with a change TVA of the throttle valve opening stored in the memory. The predetermined value is shown in FIG. 8 and FIG. 9.

Figure 10C:
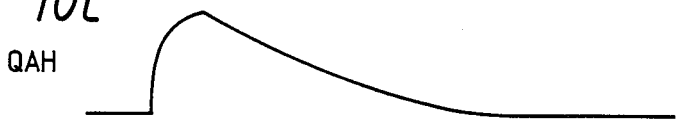

At step 603, flag FLG is set to "1". Correction value $Q_{AH}$ is determined on the basis of the throttle valve opening to the output value of the, air flow sensor 22 at step 604. Value $Q_{AH\text{-}1}$ refers to the up-dated value calculated at the last time of processing. The coefficient GEN reduces gradually the correction value $Q_{AH}$. The present embodiment performs a reduction operation using the following equation (1), however, it is possible to use a operation formula with a characteristic curve as shown in FIG. 10*c* for compensating an output characteristics curve of the air flow sensor shown in FIG. 10*b*.

$$Q_{AH}=Q_{AH\text{-}1}\times GEN+Q_{AT}-Q_{AT\text{-}1}\cdots \quad (1)$$

At step 605, the program estimates a real air flow quantity by adding the air flow quantity detected by the air flow sensor and the correction air flow quantity determined on the basis of the throttle valve opening. Basic pulse width $T_P$ for the fuel injection is calculated on the basis of the output of the estimated air flow signal. At step 606 the program determines whether a predetermined time $T_A$ has lapsed or not. When the time $T_A$ has lapsed, the program proceeds to step 627 to set flag FLG to "0". If the determination is not acceleration at step 602, the sucked air flow quantity is determined on the basis of the output of the air flow sensor 16 and no correction on the basis of the output of the throttle sensor 22 is performed, and the program proceeds to step 615. At step 608, the injection pulse $T_1$ is calculated in accordance with correction coefficient KH including water temperature correction, $Q_2$ feedback correction and learning correction, and the battery correction coefficient $T_B$.

FIG. 7 shows a flow chart for determining the correction coefficient $Q_{AD}$. When the program determines that the engine is now steady state at 507, it proceeds to step 701. Step 701 judges whether the initial value has been set or not. If there has been no initial, setting, after setting the initial value $Q_{ADS}$ as $Q_{AD}$, the program proceeds to step 601 in FIG. 5.

The value $Q_{ADS}$ is calculated by task HOSEI, and it is operated on the basis of the engine temperature T according to the following equation.

$$Q_{ADS} = \frac{1 + 0.00367 \times 50}{1 + 0.00367 \times T} \quad (2)$$

The correction coefficient $Q_{AD}$ is calculated by the air flow quantity on the basis of the air flow sensor 16 and the throttle sensor 22. The air flow sensor is capable of measuring the flow mass. In calculating air flow quantity on the basis of the output of the throttle sensor 22, it is required to compensate the calculated quantity in accordance with the pressure and temperature of the atmosphere. Step 702 determines the correction coefficient $Q_{AD}$ by the following equation (3). Filtering coefficient F is less than 1.0.

$$Q_{AD}=(Q_A/Q_{AT}-Q_{AD\text{-}1})X\ F+Q_{AD\text{-}1} \quad \ldots (3)$$

At step 703 and 704, the program determines whether or not $Q_{AD}$ is within the range of $Q_{ADMIX}$ *and* $Q_{ADMX}$. If $Q_{AD}$ exceeds the range, after changing $Q_{AD}$ to $Q_{ADMIX}$ and $Q_{ADMX}$, the program proceeds to step 601 in FIG. 6.

According to the present invention, the estimated correction air flow quantity is calculated on the basis of the valve opening after detection of the acceleration and the real flow quantity sucked into the air cylinder of the engine is estimated on the basis of the detected air flow quantity and estimated correction air flow quantity. Therefore, the fuel quantity supplied to the engine is adjusted in accordance with the real intake air flow quantity and the engine is able to maintain the theoretical air-fuel ratio.

We claim:

1. An engine control system comprising:

means for detecting air flow quantity supplied to an internal combustion engine;

means for detecting throttle valve opening;

means for detecting either acceleration or deceleration;

means for determining an estimated air flow quantity based on the throttle valve opening and the air flow quantity detected by said air flow quantity detecting means after detection of the acceleration or deceleration;

means for controlling the fuel supplied to the engine in response to the estimated air flow quantity of said determining means.

2. An engine control system comprising:

means for detecting air flow quantity supplied to an internal combustion engine;

means for detecting throttle valve opening;

means for detecting either acceleration or deceleration;

means for estimating compensation air flow quantity based on the throttle valve opening;

means for determining an estimated air flow quantity on the basis of the output of said compensation air flow quantity estimating means and the air flow quantity detected by said air flow quantity detecting means after detection of the acceleration or deceleration;

means for determining fuel quantity supplied to the engine on the basis of the estimated air flow quantity;

means for controlling the fuel supplied to the engine in response to the fuel quantity of said fuel quantity determining means.

3. An engine control system according to claim 2, said compensation air flow quantity estimating means reducing the compensation air flow quantity with respect to the lapse of time.

4. An engine control system according to claim 2, further comprising means for detecting revolution number of the combustion engine, and said compensation air flow quantity estimating means determining the compensation air flow quantity in response to the engine revolution number and the throttle valve opening.

5. An engine control system according to claim 2, said air flow quantity detecting means measuring mass flow rate of the air.

6. An engine control system according to claim 2, said compensation air flow quantity estimating means determining the compensation air flow quantity in response to the air flow quantity of said air flow quantity detecting means and the throttle valve opening.

* * * * *